US007093544B1

(12) United States Patent
Allen et al.

(10) Patent No.: US 7,093,544 B1
(45) Date of Patent: Aug. 22, 2006

(54) CONTROL DEVICE FOR A RAILROAD CAR

(75) Inventors: James George Allen, Lexington, KY (US); Alfred Arthur Lutz, Georgetown, KY (US); Jacob Daniel Rupp, II, Lexington, KY (US)

(73) Assignee: Lexair, Inc., Lexington, KY (US)

( * ) Notice: Subject to any disclaimer, the term of this patent is extended or adjusted under 35 U.S.C. 154(b) by 0 days.

(21) Appl. No.: 10/751,620

(22) Filed: Jan. 6, 2004

(51) Int. Cl.
*B61D 3/00* (2006.01)
*B61D 7/00* (2006.01)

(52) U.S. Cl. ..... 105/286; 105/311.1

(58) Field of Classification Search ..... 105/286, 105/288, 290, 308.1, 311.1, 280, 247
See application file for complete search history.

(56) References Cited

U.S. PATENT DOCUMENTS 4,326,750 A * 4/1982 Rosenbaum ..... 298/35 M
4,915,127 A * 4/1990 Werley ..... 137/505.42
5,359,942 A * 11/1994 Ward ..... 105/240
RE36,685 E * 5/2000 Bounds ..... 105/311.1
6,416,133 B1 * 7/2002 Friesen ..... 298/34 M

* cited by examiner

*Primary Examiner*—S. Joseph Morano
*Assistant Examiner*—Robert J. McCarry, Jr.
(74) *Attorney, Agent, or Firm*—Frank C. Leach, Jr.

(57) ABSTRACT

Pivotally mounted doors forming the floor of a railroad car are prevented from opening inadvertently through not allowing air pressure to be applied to a door opening piston until the air pressure exceeds a predetermined amount.

35 Claims, 10 Drawing Sheets

CONTROL DEVICE FOR A RAILROAD CAR

This invention relates to a control device for controlling simultaneous opening and simultaneous closing of a plurality of doors forming a floor of a railroad car and, more particularly, to a control device in which a predetermined air pressure must be available before opening of the doors can occur.

Railroad cars are utilized to transport material such as coal, for example, for a relatively long distance from a mine to a power plant. When a train of the railroad cars reaches a predetermined position at the power plant, it is desired for the doors forming the floor of each railroad car to simultaneously open and allow the coal to fall by gravity into a coal unloading or receiving area as each of the railroad cars is disposed over the receiving area. It also is desired to simultaneously close the doors as soon as each of the railroad cars has advanced past the coal receiving area in which the coal is to be deposited from each of the railroad cars.

Air pressure is employed to move a piston of a control device between two positions. The position of the piston controls supply of air pressure to act on a separate piston connected to the doors to move the doors between their open and closed positions. An air reservoir on each railroad car supplies the air pressure to the separate piston for opening and closing the doors on the railroad car.

The doors can be inadvertently opened, for example, when a movable element, which allows supply of air pressure to cause opening of the doors and is a solenoid plunger when a solenoid is used, is inadvertently energized. The movable element also can be inadvertently opened by a manually operated mechanism. This would occur when a person would accidentally or intentionally move the manually operated mechanism to enable air pressure to flow into a chamber in which a portion of the piston of the control device is disposed to move the piston to allow air pressure to be supplied to a cylinder having the separate piston connected to the doors therein.

The movable element also could be inadvertently opened by a pick-up shoe on the railroad car accidentally engaging a rail having a desired DC voltage, which is used to open the doors when each railroad car of the train is at the coal unloading or receiving area.

In any of these situations, the doors of the railroad car can be opened prior to the railroad car being positioned over the coal unloading or receiving area into which the coal is to be deposited. This is because the air pressure in the air reservoir on each of the railroad cars of the train is built up from a compressor in the locomotive just prior to when the coal in the railroad cars brought from the mine is to be unloaded at the power plant. As a result, the air can flow past the inadvertently opened movable element as soon as sufficient pressure is supplied from the compressor to move the separate piston connected to the doors to its door opening position.

This problem is solved by the control device of the present invention through utilizing a control element that prevents air pressure from being supplied to act on the piston in the housing of the control device to shift the piston to cause air pressure to be exerted on the separate piston, which is connected to the doors, until each railroad car is at a first predetermined position at which coal will fall into the coal unloading or receiving area when the doors open as the railroad car is continuously advanced. Thus, the air pressure must exceed a predetermined amount before the piston of the control device can be moved to allow the air pressure to be applied to the separate piston, which is connected to the doors. This can only occur when the doors in each railroad car are located over the coal unloading or receiving area since this is where a pick-up shoe on the railroad car engages a rail having the desired DC voltage and polarity.

This invention relates to a control device for controlling at least one bottom dump air operated door for a railroad car movable between a closed position in which material within the railroad car is retained within the railroad car and an open position in which the material within the railroad car is released therefrom. The control device comprises a housing, which is supported by the railroad car, having a piston movable therein between a door closing position and a door opening position in response to air pressure acting in a first direction on the piston to cause movement of the door to its open position and to air pressure acting in a second direction on the piston to cause movement of the door to its closed position. A control element prevents air pressure from acting in the first direction on the piston until the air pressure exceeds a predetermined air pressure.

The attached drawings illustrate a preferred embodiment of the present invention, in which.

Figure 1:
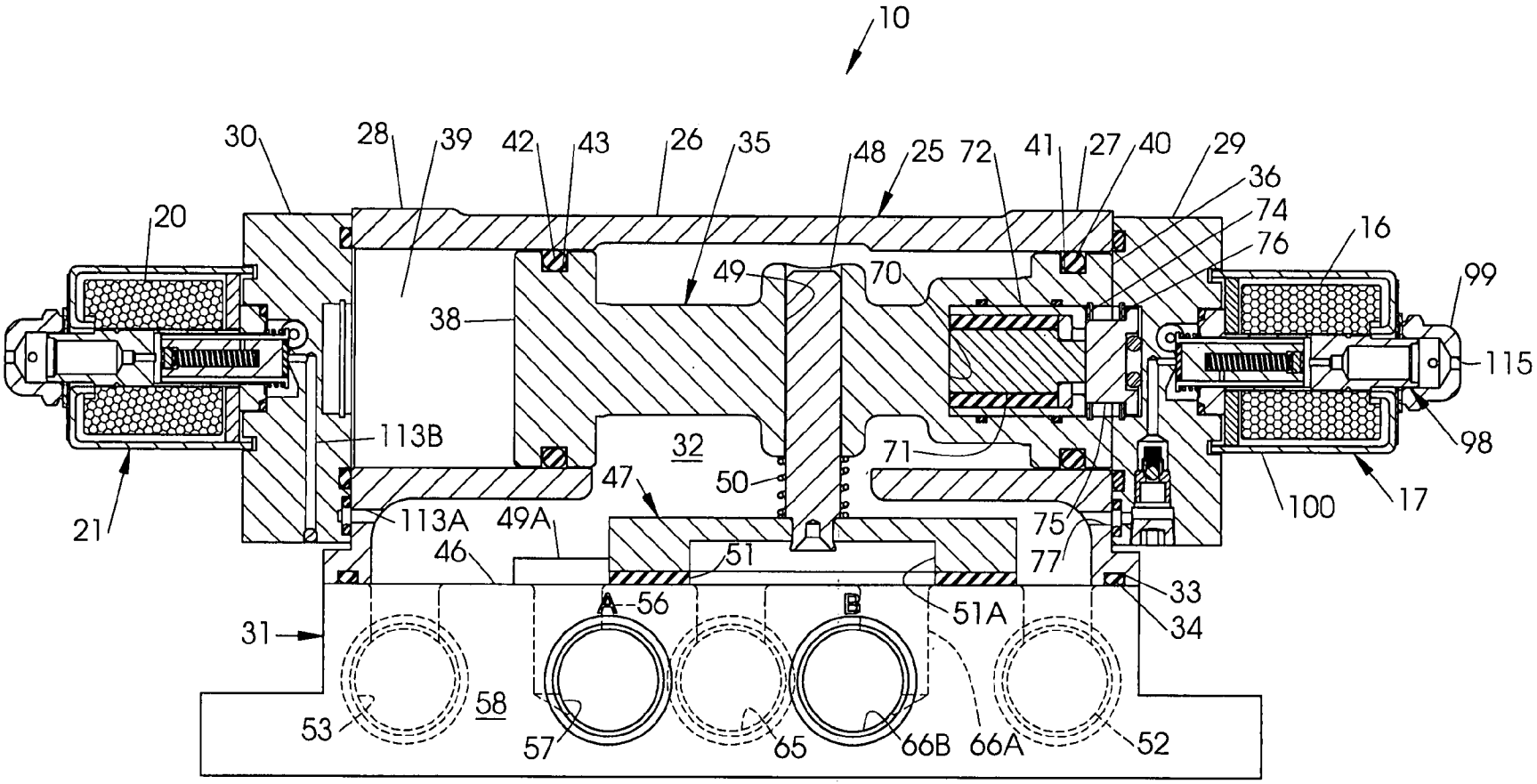
FIG. 1 is a sectional view, partly in elevation, of a control device of the present invention in its position in which doors forming a railroad car floor are closed.
Figure 2:
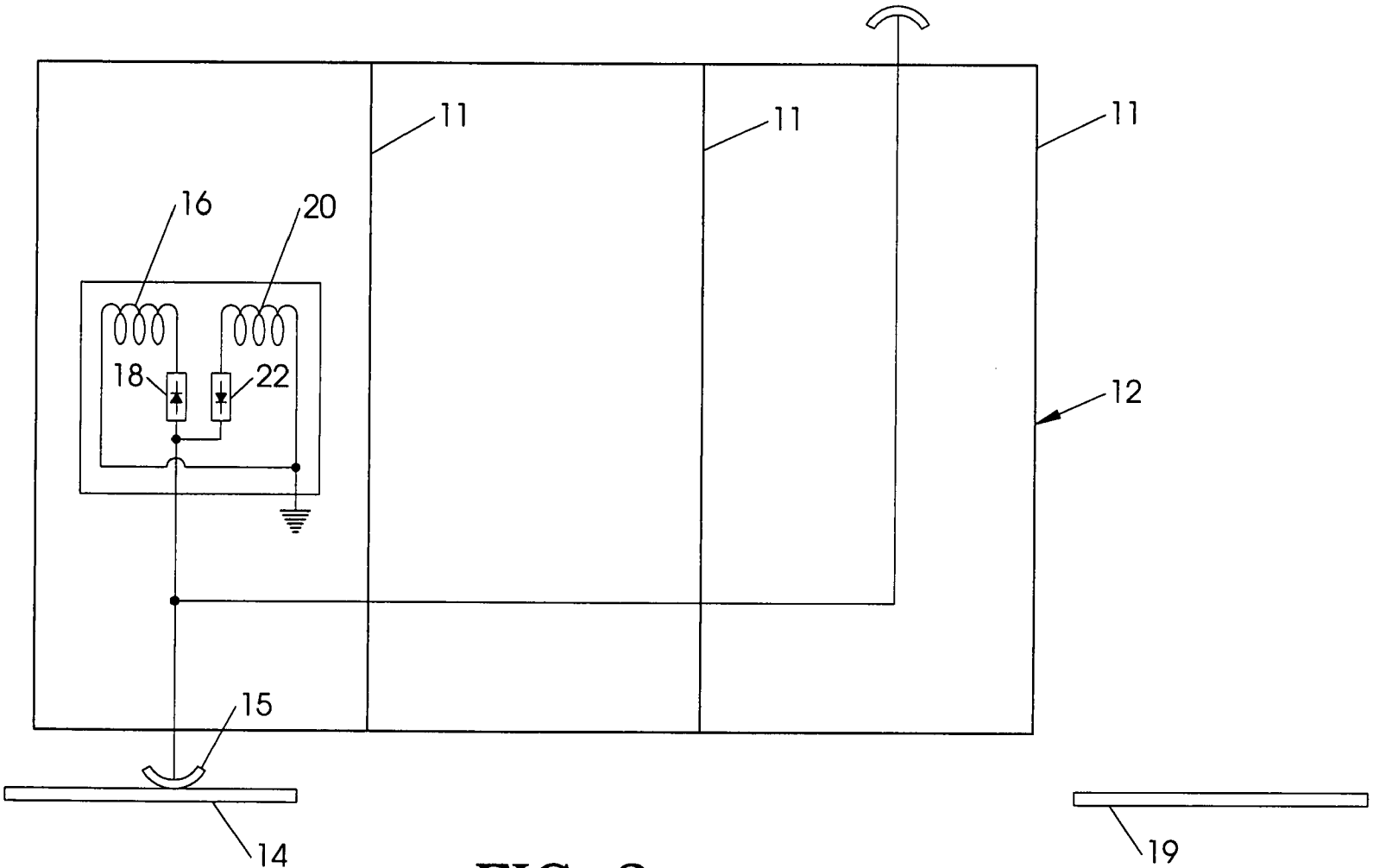
FIG. 2 is a schematic top plan view of a railroad car having the control device of the present invention and showing the doors of the railroad car and the electrical control arrangement for causing opening and closing of the doors.

Referring to the drawings and particularly FIG. 1, there is shown a control device 10 for controlling the opening and closing of a plurality of pivotally mounted doors 11 (see FIG. 2) forming the floor of a railroad car 12. Any material such as coal, for example, within the railroad car 12 can be dumped therefrom through simultaneously opening the doors 11 at a first predetermined position, which is where the coal is to be received in an unloading or receiving area at a power plant, for example.

The doors 11 are connected to each other in any suitable manner such as a beam, for example, so that all the doors 11 can be opened or closed simultaneously. Each of the doors 11 could have a pivotal portion and a fixed portion, if desired.

A rail 14 having a positive voltage of 24 DC volts, for example, is engaged by a pick-up shoe 15, which is supported by the railroad car 12, during movement of the railroad car 12. This energizes a coil 16 of a first solenoid 17 (see FIG. 1) through a diode 18 (see FIG. 2) to cause the doors 11 to be simultaneously opened at the desired first predetermined position.

As the railroad car 12 continuously advances, the pick-up shoe 15 engages a second rail 19 at a second predetermined position, which is a predetermined fixed distance from the first rail 14 in the direction of travel of the railroad car 12. The second rail 19 is charged negatively with the same voltage as the first rail 14 is charged positively. This results in a coil 20 of a second solenoid 21 (see FIG. 1), which is the same as the first solenoid 17, being energized through a diode 22 (see FIG. 2) to cause the doors 11 to simultaneously close.

The control device 10 includes a housing 25 (see FIG. 1) having a main portion or body 26 of a substantially cylindrical shape with rectangular shaped end blocks 27 and 28 at its opposite ends. An end cap 29 is attached to the rectangular shaped end block 27, and an end cap 30 is attached to the rectangular shaped end block 28.

The first solenoid 17 is supported on the exterior of the end cap 29. The second solenoid 21 is supported on the exterior of the end cap 30.

The housing 25 includes a plate 31 fixed to the body 26 in a sealing relation to form a sealed interior or space 32 of the housing 25. The housing 25 has a groove 33 around its entire bottom to receive an O-ring 34 for sealing against the plate 31 to form the sealed interior or space 32. The plate 31 is mounted on the railroad car 12 (see FIG. 2) to support the housing 25 (see FIG. 1) on the railroad car 12 (see FIG. 2).

Figure 7:
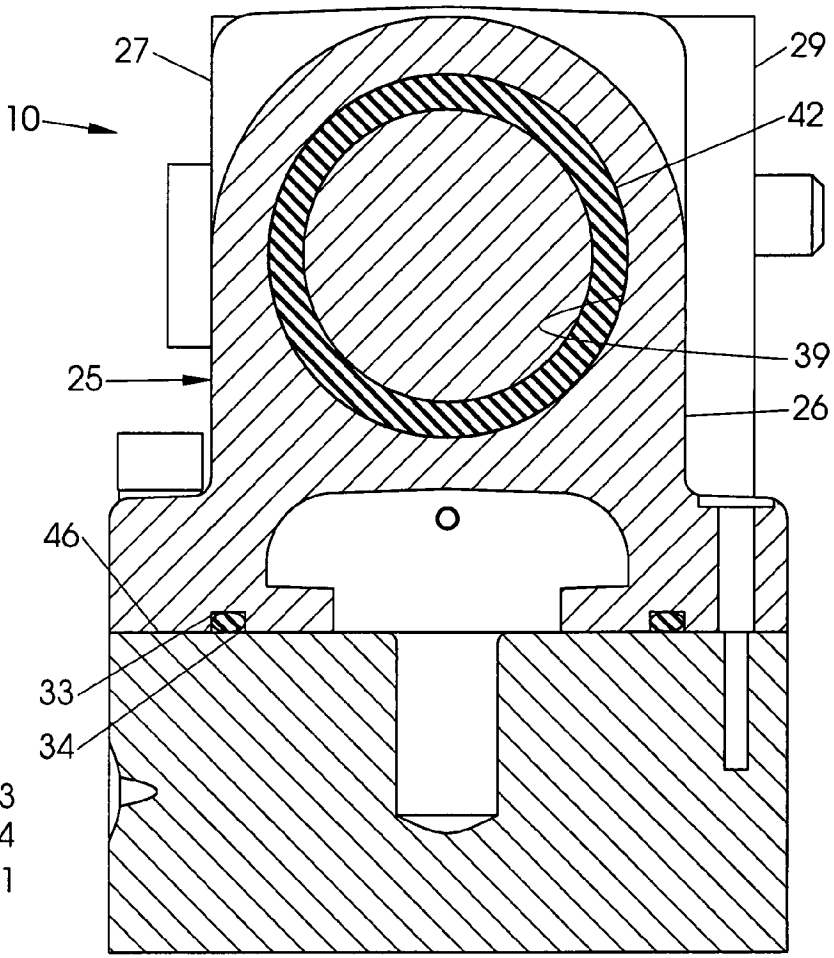
FIG. 7 is a sectional view, partly in elevation, showing the other end of the piston of the control device disposed within a second circular chamber in the housing of the control device and taken along line 7—7 of FIG. 9.
Figure 6:
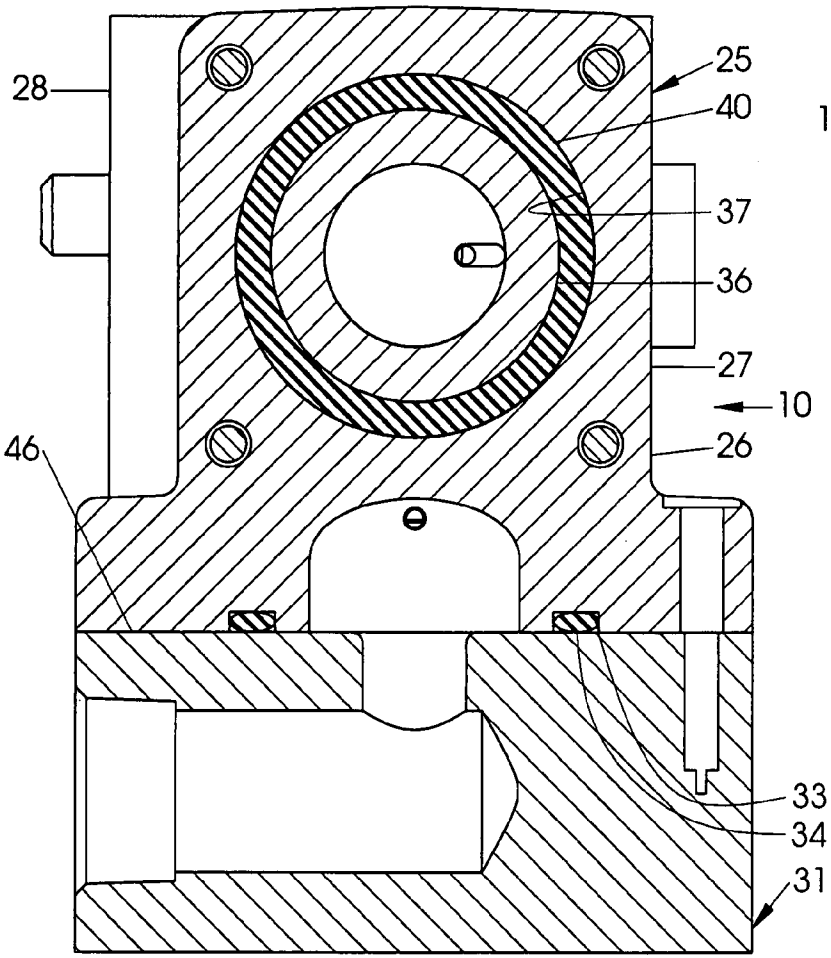
FIG. 6 is a sectional view, partly in elevation, of a portion of the control device of FIG. 1 showing one end of the piston of the control device disposed within a first circular chamber in the housing of the control device and taken along line 6—6 of FIG. 4 with parts omitted for clarity purposes.

A piston 35 (see FIG. 1) is slidably mounted within the sealed interior or space 32 of the housing 25. The piston 35 has a first circular end 36 slidably supported within a circular chamber 37 (see FIG. 6) in the body 26 of the housing 25 and a second circular end 38 (see FIG. 1) slidably supported within a circular chamber 39 (see FIG. 7) in the body 26 of the housing 25.

The first end 36 (see FIG. 1) of the piston 35 has an O-ring 40 mounted in a groove 41 therein and engaging an inner surface of the housing 25 to form a seal therebetween. Similarly, the second end 38 of the piston 35 has an O-ring 42 mounted in a groove 43 therein and engaging the inner surface of the housing 25 to form a seal therebetween. While the chambers 37 and 39 are disposed within the sealed interior 32 of the housing 26, the O-rings 40 and 42 prevent the chambers from communicating directly with the sealed interior 32.

As previously mentioned, energization of the coil 16 of the first solenoid 17 causes opening of the doors 11 (see FIG. 2) of the railroad car 12. This is accomplished through energization of the coil 16 causing air pressure to be supplied to act on the O-ring 40 (see FIG. 1) in the groove 41 in the first end 36 of the piston 35 to move the piston 35 to the left in FIG. 1.

Energization of the coil 20 (see FIG. 2) of the second solenoid 21 (see FIG. 1) causes the air pressure to be applied against the O-ring 42 in the groove 43 in the second end 38 of the piston 35. This returns the piston 35 to the position of FIG. 1 and causes the doors 11 (see FIG. 2) to be closed.

The plate 31 has a flat, upper surface 46 (see FIG. 1) along which a sliding shoe valve 47 is moved. The sliding shoe valve 47 has a circular shoe connecting pin 48 fixed thereto. The shoe connecting pin 48 is disposed within a circular passage 49 in the piston 35 so that the sliding shoe valve 47 moves horizontally with the piston 35.

A pair of guides 49A (one shown in FIG. 1 and the other shown in FIG. 9) is disposed on opposite sides of the sliding shoe valve 47 (see FIG. 1) and supported on the inner surface of the body 26 of the housing 25. The two guides 49A insure that the sliding shoe valve 47 moves along its desired linear path as the piston 35 is advanced in either direction.

A spring 50 surrounds the portion of the shoe connecting pin 48 between the piston 35 and the sliding shoe valve 47. The spring 50 continuously urges a sealing portion 51 on the sliding shoe valve 47, which has a recess 51A therein surrounded by the sealing portion 51, into sealing engagement with the surface 46 of the plate 31.

Figure 8:
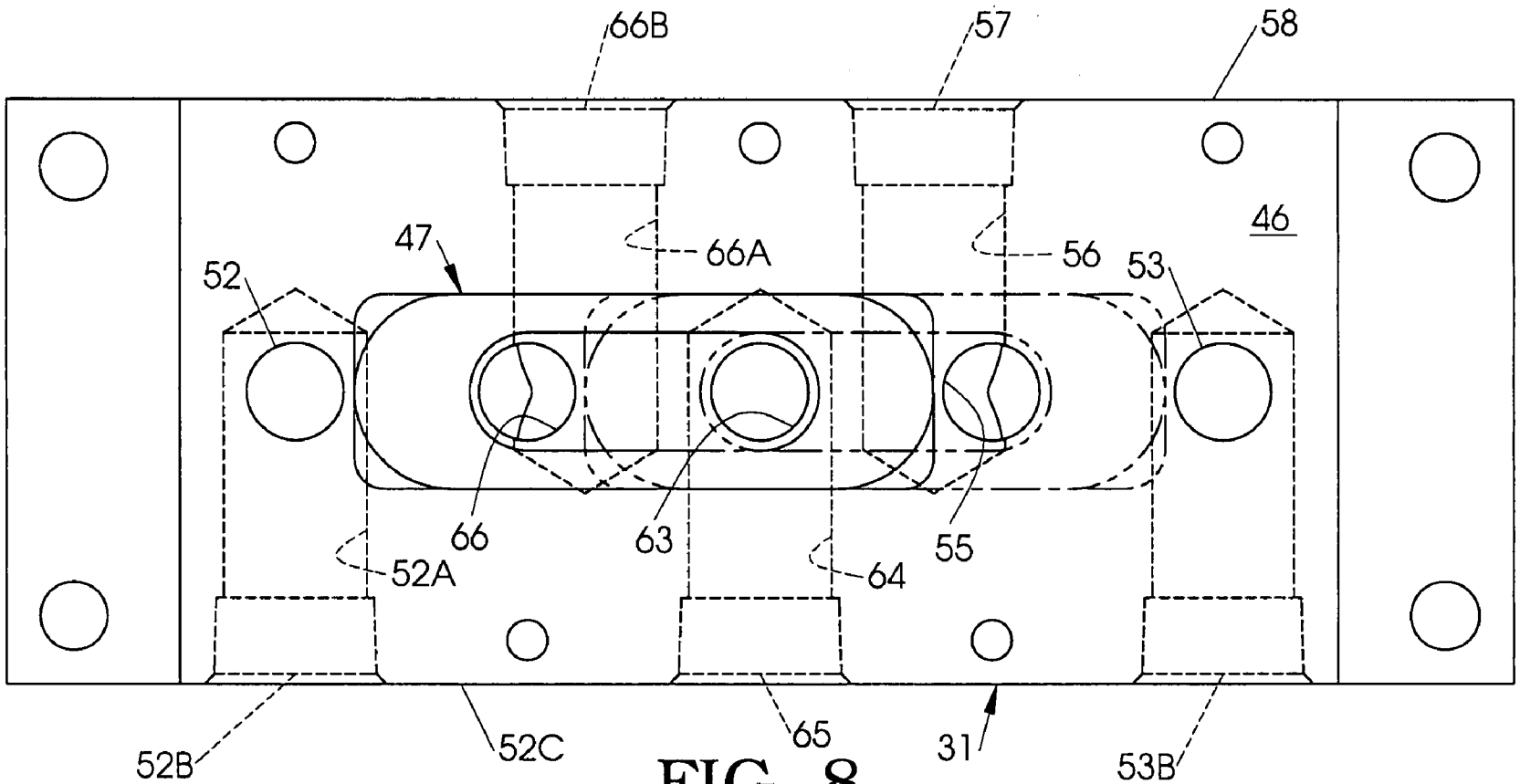
FIG. 8 is a top plan view of a plate on which a body of the housing of the control device is mounted and showing a sliding shoe valve in a solid line position when the doors of the railroad car are closed and in a phantom line position when the doors of the railroad car are open.

As shown in FIG. 8, the surface 46 of the plate 31 has two pressure ports 52 and 53 therein with only one being utilized through connection to a source of pressure; the other of the ports 52 and 53 is closed. Air pressure is supplied through the port 52 or 53 into the sealed interior or space 32 (see FIG. 1) of the housing 25 between the O-rings 40 and 42.

The port 52 (see FIG. 8) communicates through a passage 52A in the plate 31 with a port 52B (see FIG. 9) in a side surface 52C, which is substantially perpendicular to the surface 46, of the plate 31 for connection to the source of pressure. The port 53 (see FIG. 8) in the surface 46 of the plate 31 communicates through a passage 53A in the plate 31 with a port 53B (see FIG. 9) in the side surface 52C of the plate 31 for connection to the source of pressure.

Figure 3:
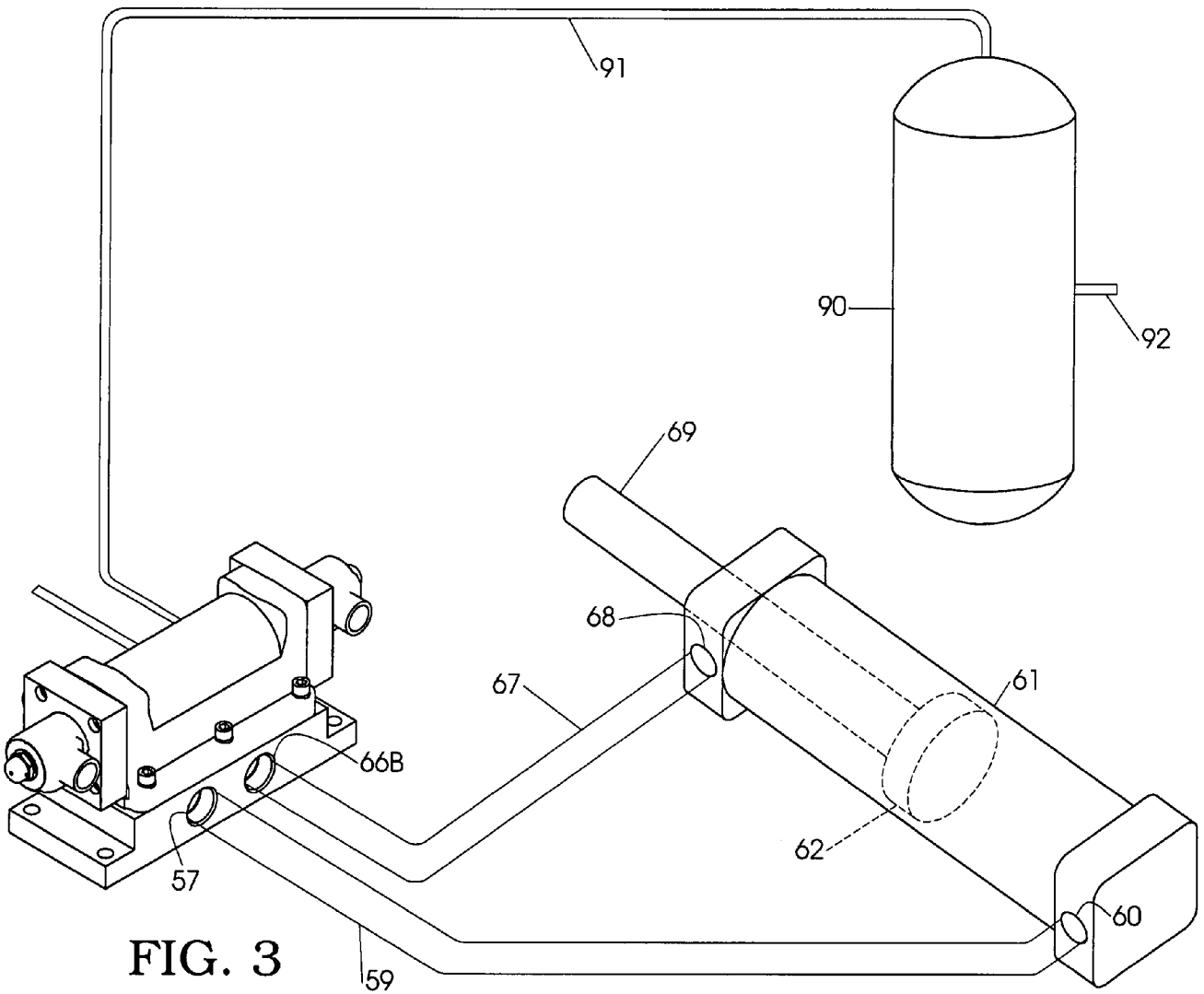
FIG. 3 is a schematic view of a source of air pressure for moving a piston in a housing of the control device of FIG. 1 to cause supply of air pressure to an air cylinder for opening and closing the doors of a railroad car.

With the sliding shoe valve 47 in the solid line position of FIG. 8, a port 55 in the surface 46 of the plate 31 supplies air pressure from the sealed interior or space 32 (see FIG. 1) of the housing 25 through a passage 56 in the plate 31 to an exit port 57 in a side surface 58, which is substantially perpendicular to the surface 46 and substantially parallel to the side surface 52C (see FIG. 9), of the plate 31. The exit port 57 (see FIG. 3) communicates through a hose 59 and a port 60 with the interior of a cylinder 61 having a piston 62 slidably mounted therein.

An exhaust port 63 (see FIG. 8) in the surface 46 of the plate 31 communicates through a passage 64 with a port 65 (see FIG. 9) in the side surface 52C of the plate 31 to the ambient. With the sliding shoe valve 47 (see FIG. 1) in the position of FIG. 1 (solid line position in FIG. 8), the exhaust port 63 (see FIG. 8) communicates with a port 66 in the surface 46 of the plate 31 through the recess 51A (see FIG. 1) in the sliding shoe valve 57. The port 66 (see FIG. 8) communicates through a passage 66A (see FIG. 1) with a port 66B in the side surface 58 of the plate 31. This exhausts the air pressure from the interior of the cylinder 61 (see FIG. 3) on the opposite side of the piston 62 from the port 60 through a hose 67 (see FIG. 3) from a port 68 communicating therewith.

A connecting rod 69 connects the piston 62 to the doors 11 (see FIG. 2); for example, the connecting rod 69 (see FIG.

3) can be connected to the beam connecting the doors 11 (see FIG. 2) to each other. Thus, when the sliding shoe valve 47 (see FIG. 1) is in the phantom line position of FIG. 8, air pressure is supplied from the port 66B through the port 68 (see FIG. 3) to the interior of the cylinder 61 and exhausted from the interior of the cylinder 61 through the port 60 to the port 57, the doors 11 (see FIG. 2) are moved to their closed positions by movement of the piston 62 (see FIG. 3) to retract the connecting rod 69.

When the doors 11 (see FIG. 2) are to be opened, the coil 16 of the first solenoid 17 (see FIG. 1) is energized. If the air pressure in the sealed interior or space 32 of the housing 25 is at a predetermined pressure, then energization of the first solenoid 17 allows air pressure to act on the O-ring 42 in the second end 38 of the piston 35 to move the piston 35 to the left in FIG. 1. When this occurs, the sliding shoe valve 47 moves to the solid line position in FIG. 8 so that the exit port 66 communicates with the exhaust port 63 and the exit port 55 communicates with the air pressure in the sealed interior or space 32 within the housing 25. This results in the piston 62 (see FIG. 3) being moved to extend the connecting rod 69 to open the doors 11 (see FIG. 2). At this time, the port 66 (see FIG. 8) is connected through the recess 51A (see FIG. 1) in the sliding shoe valve 47 with the exhaust port 63 (see FIG. 8) to allow movement of the piston 62 (see FIG. 3) to extend the connecting rod 69.

Figure 4:
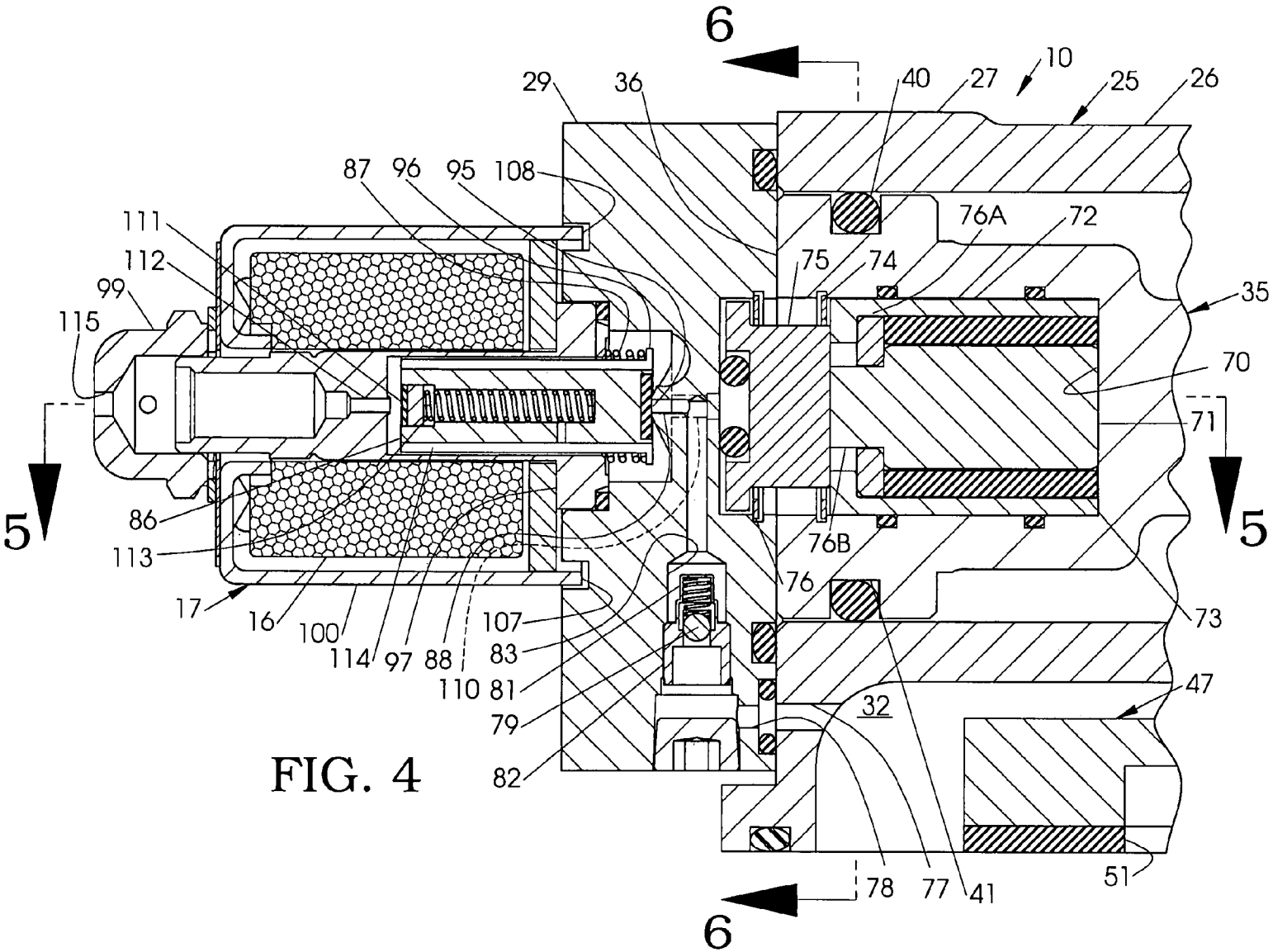
FIG. 4 is an enlarged fragmentary sectional view, partly in elevation, of a portion of the control device of FIG. 1 with a solenoid being inactivated so that air pressure is not being supplied.

The first end 36 (see FIG. 4) of the piston 35 has a recess 70 therein within which a North pole piece 71 is disposed. A magnet 72, which is a South pole, surrounds the North pole piece 71 and has a rubber sleeve 73 therebetween. The magnet 72 and the rubber sleeve 73 also are disposed in the recess 70.

The magnet 72 is retained in the recess 70 by a retaining ring 74. A South pole piece 75 engages the North pole 70. The South pole piece 75 is held within the end cap 29 by a retaining ring 76. This holds the piston 35 in the position in which the doors 11 (see FIG. 2) are closed.

An aluminum washer 76A (see FIG. 4) surrounds a reduced portion 76B of the North pole piece 71 and engages the magnet 72. This strengthens the magnetic field.

Figure 12:
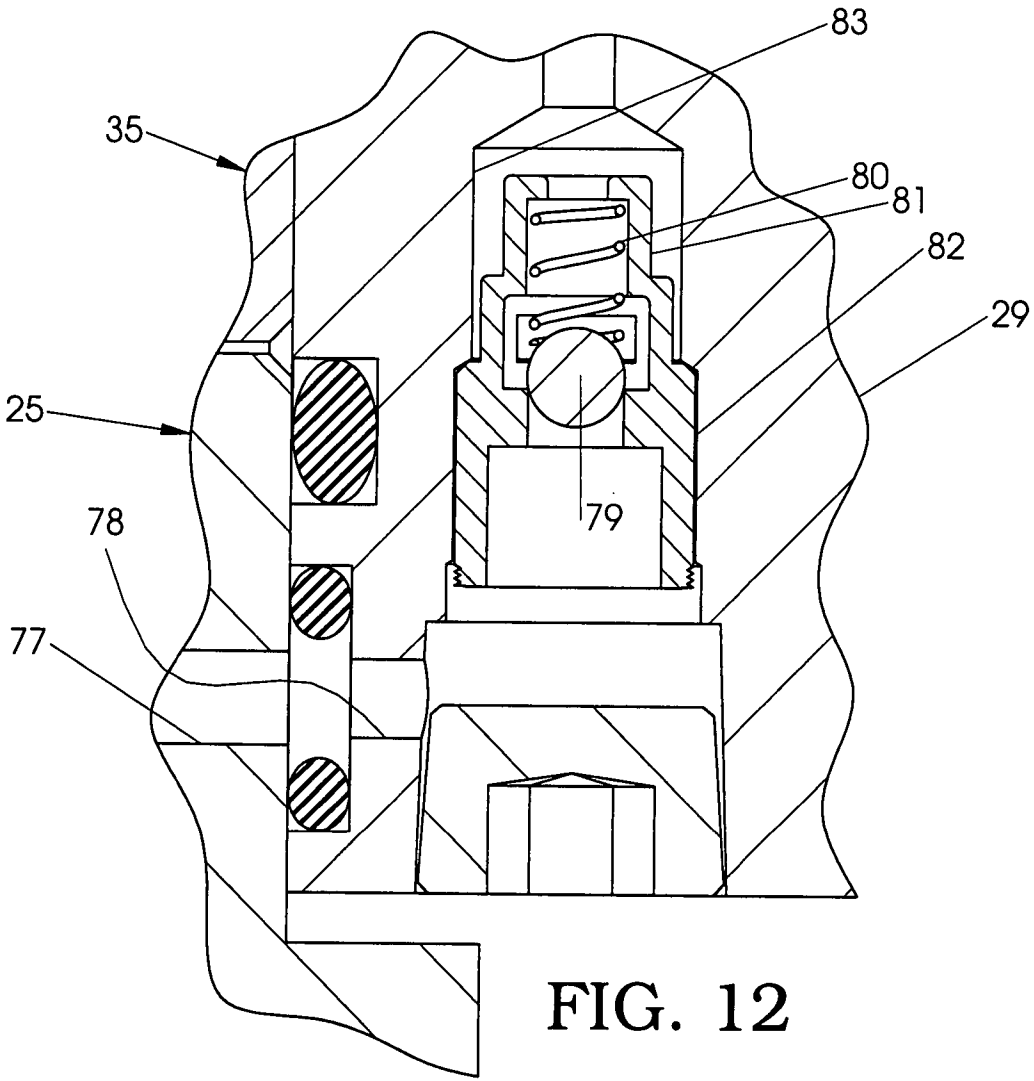
FIG. 12 is an enlarged fragmentary sectional view of a portion of the end cap of FIG. 4 and showing a ball valve in its passage blocking position.
Figure 1:
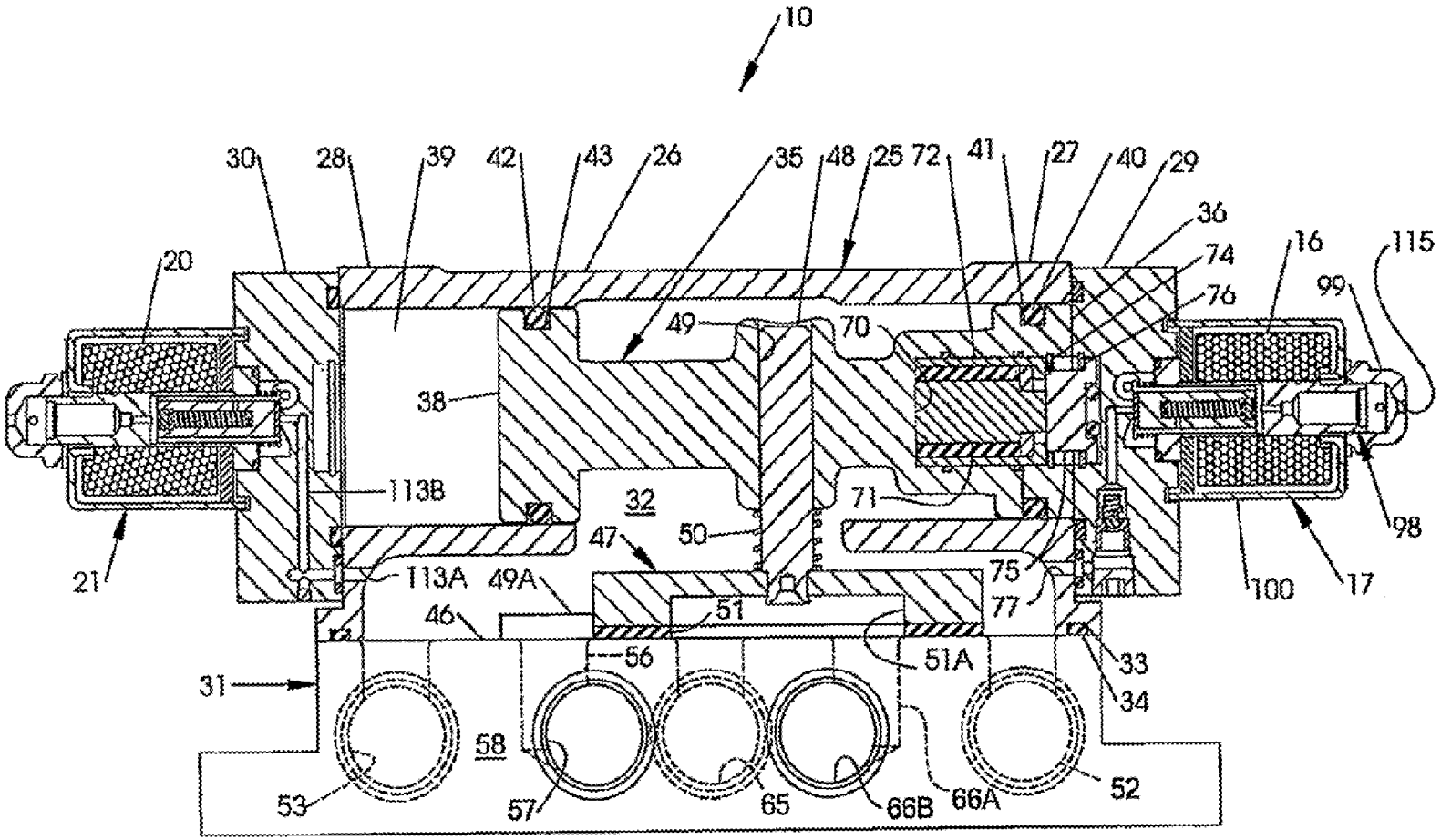
Figure 8:
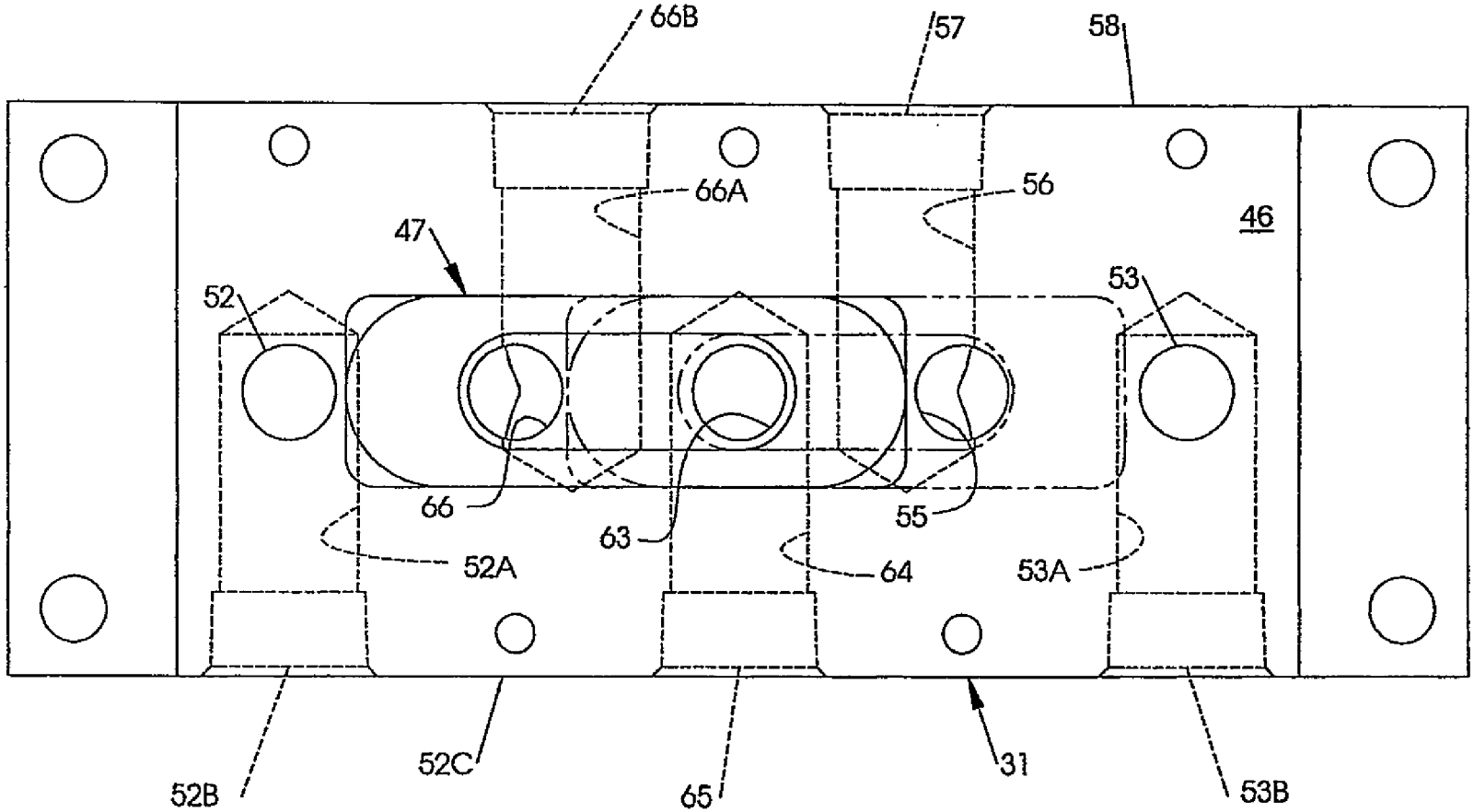
Figure 9:
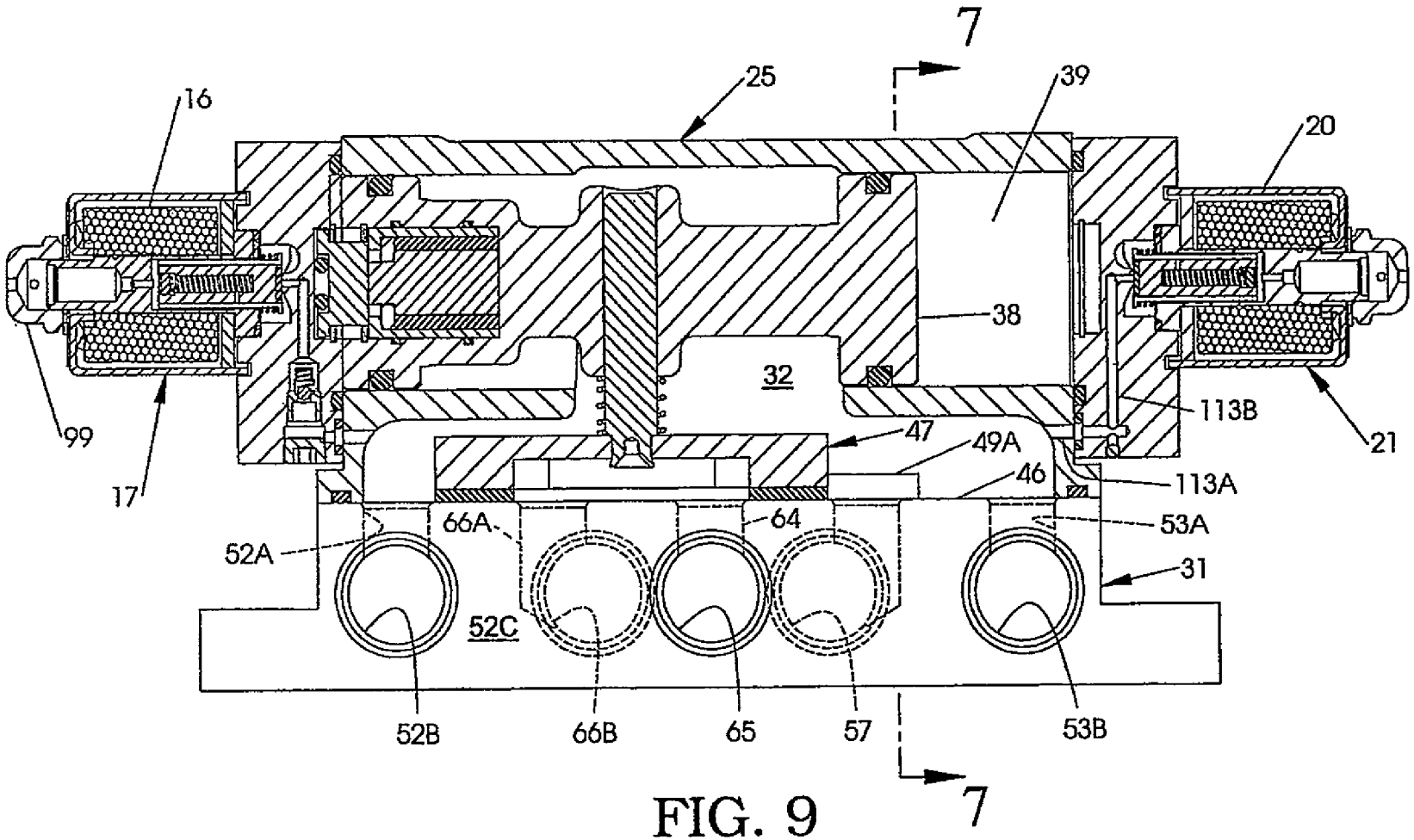

Air pressure within the sealed interior or space 32 in the housing 25 communicates through an air passage 77 in the housing 25 with an air passage 78 in the end cap 29. Until the air pressure within the sealed interior or space 32 in the housing 25 exceeds a predetermined value, a ball valve 79 (see FIG. 12) is held in a passage blocking position by a spring 80. The spring 80 is retained within a cage 81, which is part of a ball support 82 and fixed to a wall of an air passage 83 communicating with the air passage 78.

Thus, until the air pressure in the air passage 78 reaches the predetermined value, which is sufficient to overcome the force of the spring 80, the air pressure cannot be supplied to act on the O-ring 40 (see FIG. 1) even though the coil 16 of the first solenoid 17 is energized. This insures that there is no inadvertent opening of the doors 11 (see FIG. 2).

Figure 5:
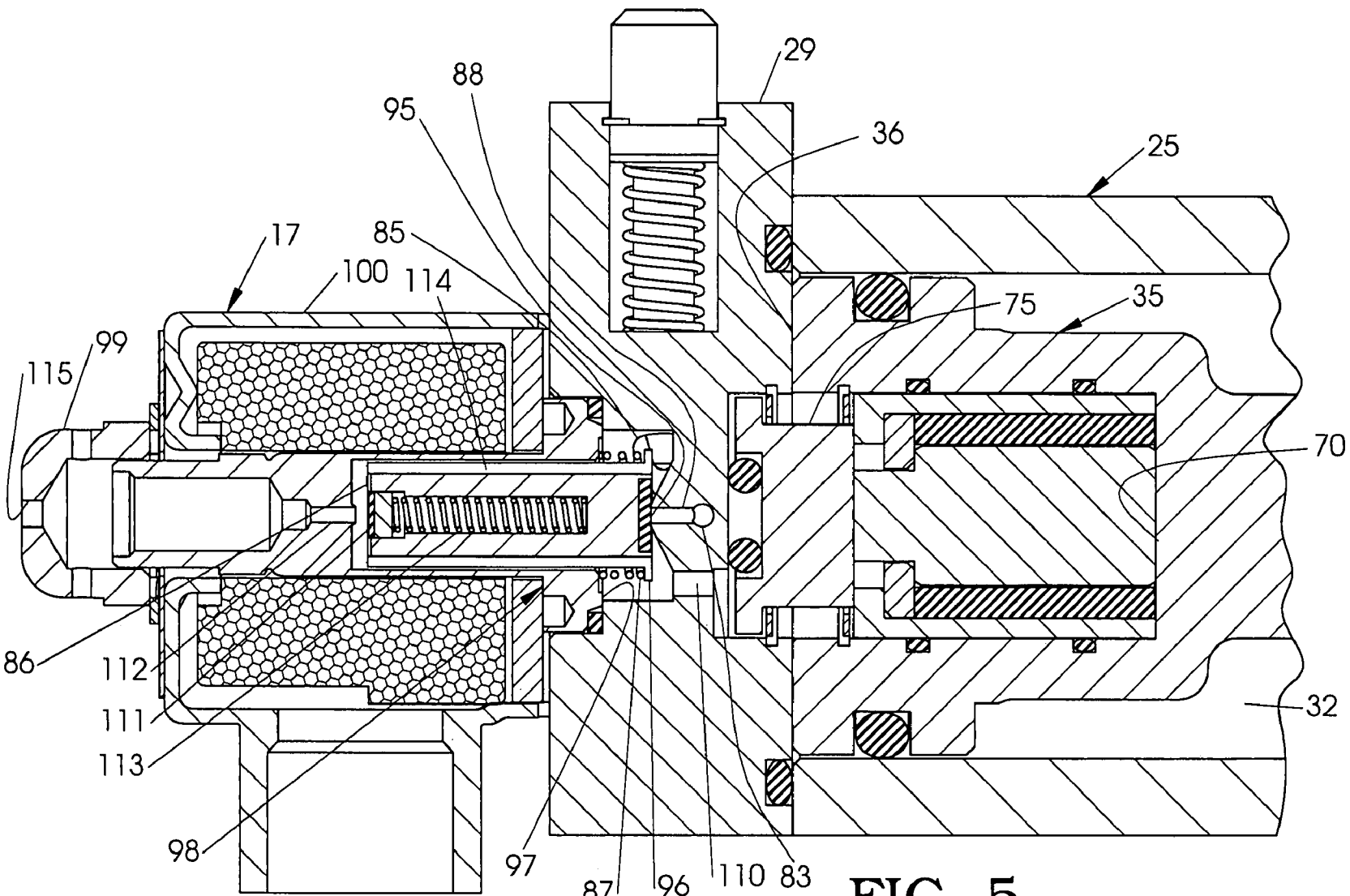
FIG. 5 is an enlarged fragmentary sectional view, partly in elevation, of a portion of the control device of FIG. 1, similar to FIG. 4 but taken at 90° to FIG. 4.

This inadvertent opening of the doors 11 could occur if a manual activator 85 (see FIG. 5) moves a solenoid plunger 86 of the first solenoid 17 against the force of a spring 87. This results in air in the air passage 83 escaping through an air passage 88 without energization of the first solenoid 17.

The air pressure is supplied from a reservoir 90 (see FIG. 3) through a hose 91 to the sealed interior or space 32 (see FIG. 9) in the housing 25. It should be understood that the reservoir 90 is supplied with the air pressure through a hose 92 from a compressor (not shown) on the locomotive of the train having a plurality of the railroad cars 12 (see FIG. 2).

The compressor is not activated until the train is near the location at which the coal is to be removed from each of the railroad cars 12. Because of the length of the trip from the coal mine to the power plant, for example, the air pressure within the reservoir 90 (see FIG. 3) drops since the compressor is not operating.

Therefore, it is necessary for the air pressure in the reservoir 90 to be replenished each time that the doors 11 (see FIG. 2) are to be opened. This is accomplished only in the last few miles before the train reaches the receiving area at which the coal is to be unloaded. Accordingly, the air pressure in the reservoir 90 (see FIG. 3) decreases between the time that the train leaves the power plant and returns to the power plant since the compressor at the locomotive, which is driving the train, is turned off after leaving the coal receiving area.

The spring 87 (see FIG. 5) continuously urges a seal 95 in the end of the plunger 86 against the end of the air passage 88. The spring 87 acts between a flange 96 on an end of the plunger 86 of the first solenoid 17 and a portion 97 of a plunger housing 98. The portion 97 is threaded on its outer surface for engagement with threads on the end cap 29. As shown in FIG. 1, the other end of the plunger housing 98 has an acorn nut 99 threaded onto threads on the plunger housing 98.

Figure 11:
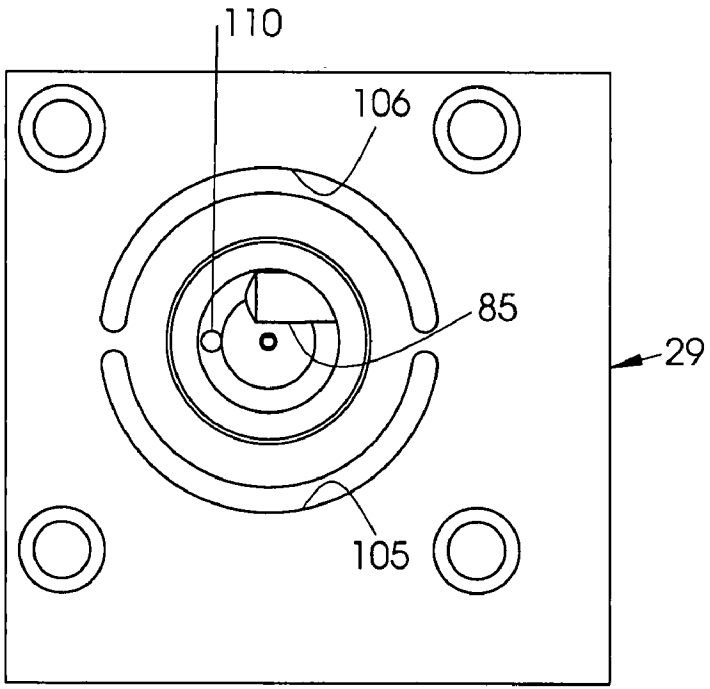
FIG. 11 is an end elevational view of the end cap of FIG. 4 and looking toward the end cap from its piston side.

The acorn nut 99 holds an end of a housing 100 of the first solenoid 17 in two arcuate grooves 105 (see FIG. 11) and 106 in the end cap 29. The housing 100 (see FIG. 4) has its end formed with two separate arcuate segments 107 and 108 fitting into the two arcuate grooves 105 (see FIG. 11) and 106, respectively, in the end cap 29.

Figure 10:
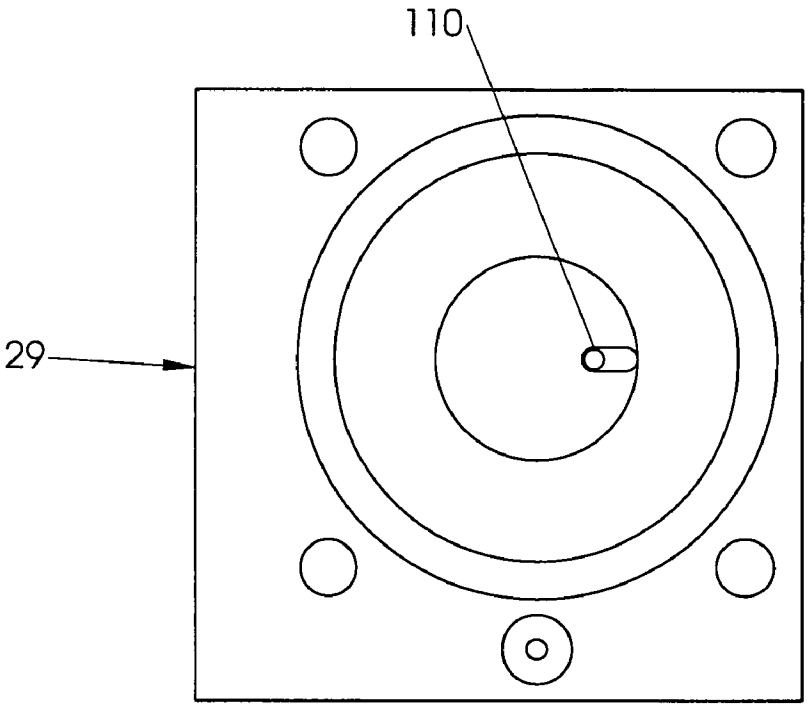
FIG. 10 is an end elevational view of an end cap of FIG. 4 looking toward the end cap from its solenoid side.

When the first solenoid 17 (see FIG. 5) is energized, the plunger 86 moves the seal 95 therein away from engagement with the end of the air passage 83. This permits the air pressure to be applied through a hole 110 (see FIG. 10) in the end cap 29 and past the pole piece 75 (see FIG. 4) to act on the first end 36 of the piston 35 so that the sliding shoe valve 47 (see FIG. 1) shifts position to enable the air pressure to be applied to the piston 62 (see FIG. 3) to extend the connecting rod 69 to open the doors 11 (see FIG. 2).

When the plunger 86 (see FIG. 4) is shifted against the force of the spring 87, a seal 111 blocks an exhaust passage 112 in the plunger housing 98 of the first solenoid 17. The seal 111 is urged by a spring 113 into engagement with the exhaust passage 112.

When the pick-up shoe 15 (see FIG. 2) ceases to engage the rail 14, the first solenoid 17 (see FIG. 1) is deenergized. As a result, the plunger 86 (see FIG. 4) is returned to the position of FIG. 4 by the spring 87. Accordingly, the air pressure within the circular chamber 37 (see FIG. 6) is removed.

Therefore, when the pick-up shoe 15 (see FIG. 2) engages the second rail 19, the second solenoid 21 (see FIG. 1) has the coil 22 (see FIG. 2) energized to supply air pressure from the sealed interior or space 32 (see FIG. 1) of the housing 25 through a passage 113A in the housing 25 and a passage 113B in the end cap 30. With the solenoid 21 energized, the air pressure is applied to the second end 38 of the piston 35 to move the piston 35 to the position of FIG. 1. As a result, the sliding shoe valve 47 (see FIG. 1) returns to the position of FIG. 1 whereby the doors 11 (see FIG. 2) are closed by retraction of the connecting rod 69 (see FIG. 3) through the air pressure acting on the piston 62 through the hose 67 and the port 68. It should be understood that the end caps 29 (see FIG. 1) and 30 are mirror images of each other except for the air passage 83 in the end cap 29 and the air passage 113B in the end cap 30.

When the spring 87 (see FIG. 5) returns the plunger 86 to the position in which the seal 95 blocks the air passage 88 on the end of the air passage 83, the air pressure acting on the first end 36 of the piston 35 escapes therefrom through the hole 110 (see FIG. 10) and four equally angularly spaced longitudinal slots 114 (see FIG. 4) on the periphery of the plunger 86. The air pressure escapes through the exhaust passage 112 and an opening 115 (see FIG. 1) in the acorn nut 99.

Accordingly, when the second solenoid 21 (see FIG. 1) has the coil 22 (see FIG. 2) energized so that air pressure is applied to the O-ring 42 (see FIG. 1) in the groove 43 in the second end 38 of the piston 35, the piston 35 is returned to the position of FIG. 1.

Therefore, it should be understood that a similar arrangement is used for exhausting the air pressure acting on the O-ring 42 in the groove 43 in the second end 38 of the piston 35 after the pick-up shoe 15 (see FIG. 2) ceases to engage the second rail 14. This is because the coil 22 of the second solenoid 21 (see FIG. 1) is no longer energized whereby the air pressure in the second chamber 39 is exhausted.

It should be understood that each of the activating elements could be air operated, for example, rather than being solenoids. Any other suitable activating element, which can be activated at predetermined positions, which are spaced a predetermined distance from each other, may be utilized.

For purposes of exemplification, a particular embodiment of the invention has been shown and described according to the best present understanding thereof. However, it will be apparent that changes and modifications in the arrangement and construction of the parts thereof may be resorted to without departing from the spirit and scope of the invention.

We claim:

1. A control device for controlling at least one bottom dump air operated door for a railroad car movable between a closed position in which material within the railroad car is retained within the railroad car and an open position in which the material within the railroad car is released therefrom comprising:

a housing supported by the railroad car;

a piston movable in said housing between a door closing position and a door opening position in response to air pressure acting in a first direction on said piston to cause movement of the door to its open position and to air pressure acting in a second direction on said piston to cause movement of the door to its closed position;

and a control element for preventing air pressure from acting in the first direction on said piston until the air pressure exceeds a predetermined air pressure.

2. The control device according to claim 1 in which said control element comprises a pressure responsive element between a source of air pressure and said piston to block supply of air pressure in the first direction for preventing the air pressure from acting in the first direction on said piston until the air pressure exceeds a predetermined air pressure.

3. The control device according to claim 2 comprising:

a first air passage in said housing communicating with a source of air pressure to cause air pressure to act on said piston in the first direction to move said piston to its door opening position when said piston is in its door closing position;

and said pressure responsive element comprising:

a first portion movably disposed in said first air passage;

and a second portion holding said first portion in a passage blocking position until the air pressure exceeds a predetermined air pressure.

4. The control device according to claim 3 in which said second portion of said pressure responsive element is a resilient element disposed in said first air passage and continuously urging said first portion of said pressure responsive element into its passage blocking position when the air pressure does not exceed the predetermined air pressure.

5. The control device according to claim 4 in which:

said first air passage has a reduced area portion;

and said first portion of said pressure responsive element is a ball urged into engagement with said reduced area portion of said first air passage by said resilient element to hold said ball in its passage blocking position.

6. The control device according to claim 5 comprising:

a second air passage in said housing communicating with the source of air pressure to cause the air pressure to act on said piston in the second direction to move said piston to its door closing position when said piston is in its door opening position;

a first activating element for allowing the air pressure to be applied to said piston to cause movement of the door to its open position when said ball is not in its passage blocking position and the railroad car is at a first predetermined position at which it is desired for the door to open to release the material in the railroad car;

and a second activating element for allowing the air pressure to be applied to said piston to cause movement of the door to its closed position when the railroad car is at a second predetermined position at which it is desired for the door to close, the second predetermined position being spaced a predetermined distance in the direction of movement of the railroad car from the first predetermined position.

7. The control device according to claim 6 in which:

said first activating element comprises a first solenoid activated in response to the railroad car being at the first predetermined position to cause the air pressure to be applied to said piston in the first direction to cause movement of the door to its open position;

and said second activating element comprises a second solenoid activated in response to the railroad car being at the second predetermined position to cause the air pressure to be applied to said piston in the second direction to cause movement of the door to its closed position.

8. A control device for controlling at least one bottom dump air operated door for a railroad car movable between a closed position in which material within the railroad car is retained within the railroad car and an open position in which the material within the railroad car is released therefrom comprising:

a housing supported by the railroad car and having a sealed interior;

said housing having first and second chambers aligned with each other in its sealed interior and spaced longitudinally from each other;

a piston slidably disposed within the sealed interior of said housing;

said piston having:

one end disposed in said first chamber in sealing relation therewith;

and its other end disposed in said second chamber in sealing relation therewith;

a first end cap mounted at one end of said housing;

said first end cap having a first air passage communicating with the sealed interior of said housing exterior of said first and second chambers and a second air passage communicating with said first chamber;

a first solenoid supported by said first end cap, said first solenoid allowing air pressure to flow through said air passage in said first end cap to said second air passage in said first end cap when said first solenoid is activated;

a second end cap mounted at the other end of said housing;

said second end cap having a first air passage communicating with the sealed interior of said housing exterior of said first and second chambers and a second air passage communicating with said second chamber;

a second solenoid supported by said second end cap, said second solenoid allowing air pressure to flow through said first air passage in said second end cap to said second air passage in said second end cap when said second solenoid is activated;

a sliding shoe valve disposed within the sealed interior of said housing exterior of said first and second chambers and connected to said piston for movement therewith;

said housing having a port communicating a source of air pressure with the sealed interior of said housing exterior of said first and second chambers;

said housing having two ports communicating with a control member for moving the door to its open or closed position depending on the position of said sliding shoe valve relative to said two ports, one of said two ports supplying air pressure to the control member from the sealed interior of said housing exterior of said first and second chambers when the door in the railroad car is to be opened and the other of said two ports supplying air pressure from the sealed interior of said housing exterior of said first and second chambers to the control member when the door in the railroad car is to be closed;

said first air passage in said first end cap supplying air pressure from the sealed interior of said housing exterior of said first and second chambers through said second air passage in said first end cap to said first chamber to move said piston to its door opening position when said first solenoid is activated;

said first air passage in said second end cap supplying air pressure from the sealed interior of said housing exterior of said first and second chambers through said second air passage in said second end cap to said second chamber to move said piston to its door closing position when said second solenoid is activated;

and a control element disposed in said first air passage in said first end cap for preventing air pressure to pass therethrough until it exceeds a predetermined air pressure.

9. The control device according to claim 8 in which said control element comprises a pressure responsive element in said first air passage in said first end cap between the sealed interior of said housing exterior of said first and second chambers and said second air passage in said first end cap to block supply of air pressure through said second air passage to said first chamber for acting on said piston to move said piston to its door opening position when said piston is in its door closing position and said first solenoid is activated until the air pressure exceeds a predetermined air pressure.

10. The control device according to claim 9 in which said pressure responsive element comprises:

a first portion movably disposed in said first air passage in said first end cap;

and a second portion holding said first portion in a passage blocking position until the air pressure exceeds a predetermined air pressure.

11. The control device according to claim 10 in which said second portion of said pressure responsive element is a resilient element disposed in said first air passage in said first end cap and continuously urging said first portion of said pressure responsive element into its passage blocking position when the air pressure does not exceed the predetermined air pressure.

12. The control device according to claim 11 in which:

said first air passage in said first end cap has a reduced area portion;

and said first portion of said pressure responsive element is a ball urged into engagement with said reduced area portion of said first air passage in said first end cap by said resilient element to hold said ball in its passage blocking position.

13. A control device for controlling at least one bottom dump air operated door for a railroad car movable between a closed position in which material within the railroad car is retained within the railroad car and an open position in which the material within the railroad car is released therefrom comprising:

a housing supported by the railroad car and having a sealed interior;

said housing having first and second chambers aligned with each other in its sealed interior and spaced longitudinally from each other;

a piston slidably disposed within the sealed interior of said housing;

said piston having:

one end disposed in said first chamber in sealing relation therewith;

and its other end disposed in said second chamber in sealing relation therewith;

a first end cap mounted at one end of said housing;

said first end cap having a first air passage communicating with the sealed interior of said housing exterior of said first and second chambers and a second air passage communicating with said first chamber;

a first activating element supported by said first end cap, said first activating element allowing air pressure to flow through said first air passage in said first end cap to said second air passage in said first end cap when said first activating element is activated;

a second end cap mounted at the other end of said housing;

said second end cap having a first air passage communicating with the sealed interior of said housing exterior of said first and second chambers and a second air passage communicating with said second chamber;

a second activating element supported by said second end cap, said second activating element allowing air pressure to flow through said first air passage in said second end cap to said second air passage in said second end cap when said second activating element is activated;

a sliding shoe valve disposed within the sealed interior of said housing exterior of said first and second chambers and connected to said piston for movement therewith;

said housing having a port communicating a source of air pressure with the sealed interior of said housing exterior of said first and second chambers;

said housing having two ports communicating with a control member for moving the door to its open or closed position depending on the position of said sliding shoe valve relative to said two ports, one of said two ports supplying air pressure to the control member from the sealed interior of said housing exterior of said first and second chambers when the door in the railroad car is to be opened and the other of said two ports supplying air pressure from the sealed interior of said housing exterior of said first and second chambers to the control member when the door in the railroad car is to be closed;

said first air passage in said first end cap supplying air pressure from the sealed interior of said housing exterior of said first and second chambers through said second air passage in said first end cap to said first chamber to move said piston to its door opening position when said first activating element is activated;

said first air passage in said second end cap supplying air pressure from the sealed interior of said housing exterior of said first and second chambers through said second air passage in said second end cap to said second chamber to move said piston to its door closing position when said second activating element is activated;

and a control element disposed in said first air passage in said first end cap for preventing air pressure to pass therethrough until it exceeds a predetermined air pressure.

14. The control device according to claim 13 in which said control element comprises a pressure responsive element in said first air passage in said first end cap between the sealed interior of said housing exterior of said first and second chambers and said second air passage in said first end cap to block supply of air pressure through said second air passage to said first chamber for acting on said piston to move said piston to its door opening position when said piston is in its door closing position and said first activating element is activated until the air pressure exceeds a predetermined air pressure.

15. The control device according to claim 14 in which said pressure responsive element comprises:

a first portion movably disposed in said first air passage in said first end cap;

and a second portion holding said first portion in a passage blocking position until the air pressure exceeds a predetermined air pressure.

16. The control device according to claim 15 in which said second portion of said pressure responsive element is a resilient element disposed in said first air passage in said first end cap and continuously urging said first portion of said pressure responsive element into its passage blocking position when the air pressure does not exceed the predetermined air pressure.

17. The control device according to claim 16 in which:

said first air passage in said first end cap has a reduced area portion;

and said first portion of said pressure responsive element is a ball urged into engagement with said reduced area portion of said first air passage in said first end cap by said resilient element to hold said ball in its passage blocking position.

18. A control device for controlling at least one bottom dump air operated door for a railroad car movable between a closed position in which material within the railroad car is retained within the railroad car and an open position in which the material within the railroad car is released therefrom comprising:

a housing supported by the railroad car;

a piston movable in said housing between a door closing position and a door opening position in response to air pressure acting in a first direction on said piston to cause movement of the door to its open position and to air pressure acting in a second direction on said piston to cause movement of the door to its closed position;

and a resiliently biased control element for preventing movement of said piston to its door opening position until the air pressure acting on said piston exceeds a predetermined air pressure.

19. The control device according to claim 18 in which said resiliently biased control element comprises a pressure responsive element between a source of air pressure and said piston to block supply of air pressure in the first direction for preventing the air pressure from acting in the first direction on said piston until the air pressure exceeds a predetermined air pressure.

20. The control device according to claim 19 comprising:

a first air passage in said housing communicating with a source of air pressure to cause air pressure to act on said piston in the first direction to move said piston to its door opening position when said piston is in its door closing position;

and said pressure responsive element comprising:

a first portion movably disposed in said first air passage;

and a second portion holding said first portion in a passage blocking position until the air pressure exceeds a predetermined air pressure.

21. The control device according to claim 20 in which said second portion of said pressure responsive element is a resilient element disposed in said first air passage and continuously urging said first portion of said pressure responsive element into its passage blocking position when the air pressure does not exceed the predetermined air pressure.

22. A control device for controlling at least one bottom dump air operated door for a railroad car movable between a closed position in which material within the railroad car is retained within the railroad car and an open position in which the material within the railroad car is released therefrom only when the railroad car is at a predetermined position along its predetermined travel path at which it is desired for the door to open comprising:

a housing supported by the railroad car;

a piston movable in said housing between a door closing position and a door opening position in response to air pressure acting in a first direction on said piston to cause movement of the door to its open position and to air pressure acting in a second direction on said piston to cause movement of the door to its closed position;

and a control element for preventing the door from opening until the railroad car is at the predetermined position along its predetermined travel path and the air pressure in said housing exceeds a predetermined air pressure.

23. The control device according to claim 22 in which said control element prevents the door from opening until the railroad car is at the predetermined position along its predetermined travel path by preventing air pressure from acting in the first direction on said piston until the air pressure in said housing exceeds a predetermined air pressure at the predetermined position of the railroad car along its predetermined travel path.

24. A method for controlling at least one bottom dump air operated door for a railroad car movable between a closed position in which material within the railroad car is retained within the railroad car and an open position in which the material within the railroad car is desired to be released therefrom only when the railroad car is at a predetermined position along its predetermined travel path comprising:

moving a piston in a housing between a door closing position and a door opening position in response to air pressure acting in a first direction on the housing piston to cause movement of the door to its open position and to air pressure acting in a second direction on the housing piston to cause movement of the door to its closed position;

and preventing movement of the housing piston to its door opening position at the predetermined position of the railroad car along its predetermined travel path until a predetermined air pressure in the housing is exceeded.

25. The method according to claim 24 comprising preventing the air pressure in the housing from acting in the first direction on the housing piston to cause movement of the door to its open position unless the railroad car is at the predetermined position along its predetermined travel path and it is determined that the air pressure in the housing acting in the first direction on the housing piston exceeds a predetermined air pressure.

26. The method according to claim 25 comprising:

supplying the air pressure in the housing to act on a piston connected to the door and disposed in a cylinder supported by the railroad car to move the door connected piston to open the door when the housing piston is moved in the first direction;

and supplying the air pressure in the housing to act on the door connected piston and disposed in the cylinder supported by the railroad car to move the door connected piston to close the door when the housing piston is moved in the second direction.

27. The method according to claim 24 comprising:

supplying the air pressure in the housing to act on a piston connected to the door and disposed in a cylinder supported by the railroad car to move the door connected piston to open the door when the housing piston is moved in the first direction;

and supplying the air pressure in the housing to act on the door connected piston and disposed in the cylinder supported by the railroad car to move the door connected piston to close the door when the housing piston is moved in the second direction.

28. A railroad car having at least one bottom dump air operated door movable between a closed position in which material within the railroad car is retained within the railroad car and an open position in which the material within the railroad car is released therefrom only when the railroad car is at a predetermined position along its predetermined travel path at which it is desired for said door to open;

a cylinder supported by the railroad car;

a piston disposed in said cylinder and connected to said door for moving said door between its closed and open positions;

a control device for controlling supply of air pressure to said door connected piston to move said door between its closed and open positions;

and said control device comprising:

a housing supported by the railroad car;

a piston movable in said housing between a door closing position and a door opening position in response to air pressure acting in a first direction on said housing piston to cause movement of the door to its open position and to air pressure acting in a second direction on said housing piston to cause movement of the door to its closed position;

said housing piston allowing air pressure in said housing to act on one side of said door connected piston to open said door when the air pressure moves said housing piston to its door opening position to enable the air pressure in said housing to flow from said housing to said cylinder to act on the one side of said door connected piston;

said housing piston allowing air pressure in said housing to act on the other side of said door connected piston to close said door when the air pressure moves said housing piston to its door closing position to enable the air pressure in said housing to flow from said housing to said cylinder to act on the other side of said door connected piston;

and a control element for preventing movement of said housing piston to enable air pressure to flow from said housing to said cylinder to act on the one side of said door connected piston to open said door until the air pressure exceeds a predetermined air pressure at the predetermined position of the railroad car along its predetermined travel path.

29. The railroad car according to claim 28 in which said control element comprises a pressure responsive element between a source of air pressure and said housing piston to block supply of the air pressure in the first direction for preventing the air pressure from acting in the first direction on said housing piston until the air pressure exceeds a predetermined air pressure.

30. The railroad car according to claim 29 comprising:

a first air passage in said housing communicating with a source of air pressure to cause air pressure to act on said housing piston in the first direction to move said housing piston to its door opening position when said housing piston is in its door closing position;

and said pressure responsive element comprising:

a first portion movably disposed in said first air passage;

and a second portion holding said first portion in a passage blocking position until the air pressure exceeds a predetermined air pressure.

31. The railroad car according to claim 30 in which said second portion of said pressure responsive element is a resilient element disposed in said first air passage and continuously urging said first portion of said pressure responsive element into its passage blocking position when the air pressure does not exceed the predetermined air pressure.

32. A control device for controlling at least one bottom dump air operated door for a railroad car movable between a closed position in which material within the railroad car is retained within the railroad car and an open position in which the material within the railroad car is released therefrom only when the railroad car is at a predetermined position along its predetermined travel path at which it is desired for the door to open comprising:

a housing supported by the railroad car;

a piston movable in said housing between a door closing position and a door opening position in response to air pressure acting in a first direction on said piston to cause movement of the door to its open position and to air pressure acting in a second direction on said piston to cause movement of the door to its closed position;

and a control element for preventing movement of said piston to its door opening position at the predetermined position along its predetermined travel path until a predetermined air pressure in said housing is exceeded.

33. The control device according to claim 32 in which said control element comprises a pressure responsive element between a source of air pressure and said piston to block supply of the air pressure in the first direction for preventing the air pressure from acting in the first direction on said piston until the air pressure exceeds a predetermined air pressure.

34. The control device according to claim 33 comprising:

a first air passage in said housing communicating with a source of air pressure to cause air pressure to act on said piston in the first direction to move said piston to its door opening position when said piston is in its door closing position;

and said pressure responsive element comprising:

a first portion movably disposed in said first air passage;

and a second portion holding said first portion in a passage blocking position until the air pressure exceeds a predetermined air pressure.

35. The control device according to claim 34 in which said second portion of said pressure responsive element is a resilient element disposed in said first air passage and continuously urging said first portion of said pressure responsive element into its passage blocking position when the air pressure does not exceed the predetermined air pressure.

* * * * *

UNITED STATES PATENT AND TRADEMARK OFFICE

CERTIFICATE OF CORRECTION

PATENT NO. : 7,093,544 B1
APPLICATION NO. : 10/751620
DATED : August 22, 2006
INVENTOR(S) : Allen et al.

It is certified that error appears in the above-identified patent and that said Letters Patent is hereby corrected as shown below:

On the Title Page (56)
The following U.S. patents should be listed under References Listed

--

| | | |
|---|---|---|
| 3,173,381 | 3/1965 | Charles et al |
| 3,540,480 | 11/1970 | Leibfritz |
| 3,596,565 | 8/1971 | Atkinson |
| 3,730,360 | 5/1973 | Aquino et al |
| 3,828,948 | 8/1974 | Peterson |
| 3,897,719 | 8/1975 | Tipton |
| 3,917,084 | 11/1975 | Swisher, Jr. et al |
| 4,153,168 | 5/1979 | Reustle |
| 4,542,701 | 9/1985 | Fischer et al |
| 4,726,393 | 2/1988 | Herner |
| 5,419,262 | 5/1995 | Turpin, Sr. |
| 5,868,157 | 2/1999 | Yoshimura et al |
| 6,067,912 | 5/2000 | Miller |
| 6,192,804 B1 | 2/2001 | Snead |
| 6,257,150 Bl | 7/2001 | Burke |
| 6,286,535 B1 | 9/2001 | Harms et al |
| 6,604,469 B1 | 8/2003 | Galvan et al |

--

Figure 9:
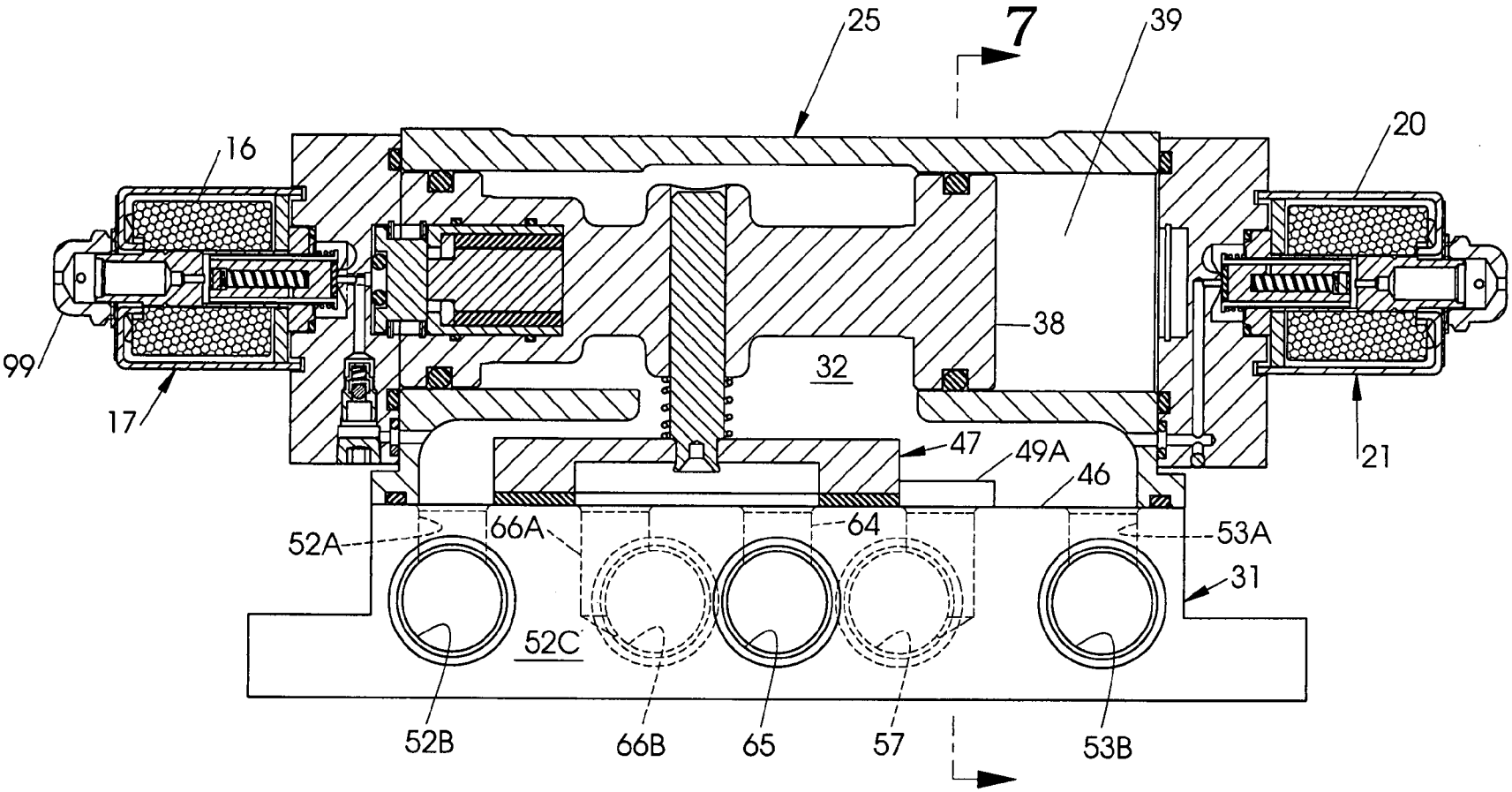
FIG. 9 is a sectional view, partly in elevation, of the control device, similar to FIG. 1, but taken from the opposite side of the control device than FIG. 1.

Delete FIGS. 1, 8, and 9 and substitute included FIGS. 1, 8, and 9 as shown in attached
Col. 3, line 60, “37 and 39” should read -- 37 (see FIG. 7) and 39 (see FIG. 1) --
Col. 4, line 9, “31 has a flat, upper surface 46 (see FIG. 1)” should read -- 31 (see FIG. 1) has a flat, upper surface 46 --
Col. 5, line 34, “70” should read -- piece 71 --
Col. 6, line 54, “22” should be -- 20 --
Col. 7, line 11, “22” should be -- 20 --
Col. 7, line 19, “14” should be -- 19 --

UNITED STATES PATENT AND TRADEMARK OFFICE

CERTIFICATE OF CORRECTION

PATENT NO. : 7,093,544 B1
APPLICATION NO. : 10/751620
DATED : August 22, 2006
INVENTOR(S) : Allen et al.

It is certified that error appears in the above-identified patent and that said Letters Patent is hereby corrected as shown below:

Col. 7, line 19, "22" should be -- 20 --

Signed and Sealed this

Tenth Day of July, 2007

JON W. DUDAS
*Director of the United States Patent and Trademark Office*